United States Patent [19]

Cusumano et al.

[11] Patent Number: 4,554,877

[45] Date of Patent: Nov. 26, 1985

[54] ALIGNMENT SYSTEM FOR A GARMENT ACCESSORY-HOLDING JIG

[75] Inventors: Salvatore V. Cusumano, Moscow; Aaron Glassman, Scranton, both of Pa.

[73] Assignee: P.S.R., Incorporated, Lake Ariel, Pa.

[21] Appl. No.: 679,021

[22] Filed: Dec. 6, 1984

Related U.S. Application Data

[63] Continuation-in-part of Ser. No. 486,799, Apr. 20, 1983, Pat. No. 4,524,704.

[51] Int. Cl.[4] ..... D05B 3/18

[52] U.S. Cl. ..... 112/105; 112/77; 112/114

[58] Field of Search ..... 112/106, 104, 105, 107, 112/108, 109, 110, 111, 12, 153, 113, 115, 70, 77, 114

[56] References Cited

U.S. PATENT DOCUMENTS

| | | | |
|---|---|---|---|
| 3,369,508 | 2/1968 | Howard | 112/77 |
| 3,415,210 | 12/1968 | Glassman | 112/114 |
| 4,363,280 | 12/1982 | Lindquist | 112/105 |
| 4,493,275 | 1/1985 | Fischer | 112/105 |

*Primary Examiner*—Werner H. Schroeder
*Assistant Examiner*—Andrew M. Falik
*Attorney, Agent, or Firm*—Kane, Dalsimer, Kane, Sullivan and Kurucz

[57] ABSTRACT

A jig for holding an accessory having at least two sets of thread holes while being stitched on a sewing machine includes an attachment plate attachable to the sewing machine in predetermined relationship with respect to the needle of the sewing machine and includes a sliding bar held in slidable relationship with the attachment plate. Also included is a first location-determining device to secure the sliding bar in at least two predetermined positions, a holding device attached to, and extending from, the sliding bar to a location below the needle of the sewing machine, permitting the alignment of at least two sets of thread holes on the accessory with the needle of the sewing machine when the sliding bar is moved to a desired location, and an alignment system having a guide template affixed to the holding device. An indicator arm is affixed to the attachment plate which is aligned with a desired location on the guide template in order to indicate alignment of the needle of the sewing machine.

15 Claims, 7 Drawing Figures

ALIGNMENT SYSTEM FOR A GARMENT ACCESSORY-HOLDING JIG

This is a continuation in part of application Ser. No. 06/486,799 filed 4/20/83, now U.S. Pat. No. 4,524,704.

BACKGROUND OF THE INVENTION

This invention relates generally to sewing-machine jigs for holding accessories while they are being sewn and, more specifically, to jigs for holding skirt hooks or skirt eyes during the process of sewing them onto fabric.

Previous jigs for holding wire accessories, such as belt hooks and eyes, while they are being sewn onto fabric, are not adapted for sewing skirt hooks and eyes, which are stamped from sheet metal. Accessories that are made from sheet metal are more massive and generally have thread holes that are considerably smaller than the holes in the previously-used wire accessories. These holes are arranged in sets of one or more holes with the sets of holes being remote and precisely positioned from each other. A typical skirt eye, for instance, is a dumbbell-shaped piece of sheet metal with the eye formed by a bar that is in a slightly different plane from the wider end portions. A pair of small thread holes is located in each of the wider end portions of the skirt eye. A typical skirt hook is also made from sheet metal and is formed by folding to yield two layers. The upper layer is tongue shaped and the lower layer has three thread-hole sets in an approximately semi-circular arrangement. A pair of small thread holes is located on a third extension midway between the others on the arc of the semicircle. This three-point configuration gives the skirt hook the required stability to prevent the end of the hook from lifting away from the fabric when the skirt hook is interlocked with the skirt eye while on a garment.

In prior jigs, the position of the jig is under the control of the sewing machine and requires the machine to be set up and maintained for a single type accessory. It is desirable to provide a jig whose position can be under the control of the operator.

In co-pending application Ser. No. 486,799, U.S. Pat. No. 4,524,704 a jig is disclosed having a marker arm to align one set of holes, on an accessory, with the needle, thereby assuring that predetermined adjustments of the jig will align the needle with the other thread holes in the accessory. A drawback to this alignment system is that the needle and its supporting hardware prevent straight ahead viewing by the operator and thus hinder alignment of the needle with the thread hole sets. In addition, the device disclosed in co-pending application Ser. No. 486,799, U.S. Pat. No. 4,524,704 requires replacement of the jig when alternating from sewing one accessory to sewing another, e.g. when sewing skirt hooks after sewing skirt eyes.

SUMMARY OF THE INVENTION

The primary object of the present invention is to provide a jig having an accurate alignment system which employs a guide template to which the jig is aligned thereby providing a highly visible alignment template which is not obstructed during operation. The guide template is designed so that it contains thread-hole sets in locations corresponding to the locations of the thread-hole sets on the accessory to be sewn. Thus by adjusting the jig so that the indicator pointer points to a particular thread-hole set on the guide template, the operator is assured that the sewing needle is aligned to sew a corresponding thread-hole set on the accessory to be sewn. Thus an improved alignment system is provided which is laterally displaced from the sewing needle to provide viewing clearance including a guide template which is placed on a raised platform to provide a prominent alignment guide. The present alignment system provides rapid and easy alignment and, is adaptable to applications with any clasp or button operation.

Another object of the present invention is to provide a single jig which may be used to sew a wide variety of accessories thereby overcoming the need in the prior art to change jigs when sewing a different accessory. To this end the present jig is provided with a holding means that comprises a holding plate and a spring biased clip. The holding means is adapted to secure a variety of accessories and thus a single jig may be employed despite alternating between sewing skirt hooks and skirt eyes.

The novel jig holds an accessory during machine sewing and permits convenient and rapid repositioning of such accessory to several different predetermined positions under operator control. These predetermined sewing positions correspond to the exact locations of the thread-hole sets on the accessory and, therefore, the accessory can be sewn to the fabric at more than one attachment point with only one insertion of the accessory into the jig.

The present jig is provided with a lever located on top of the attachment plate to facilitate adjustment by an operator and to permit adaptation to many makes of sewing machines.

The novel jig comprises a first captive sliding bar, an accessory holder attached to the sliding bar, and an alignment system. The alignment system includes an indicator arm which is affixed on one end to a stationary jig attachment plate and has, on its opposite end, an alignment pointer. The alignment pointer is designed to point to a thread hole on an alignment template which has thread holes at locations corresponding to thread holes on the accessory to be sewn. There are a plurality of stop positions, which may be detents, on the first sliding bar, which detents correspond in spacing to the spacing in one direction between the thread-hole sets in the accessory. The jig may include a second captive sliding bar between the first sliding bar and the accessory holder, to furnish motion transverse to the motion in the first sliding bar and stop positions related to the positions in another orthogonal direction between the thread-hole sets on the accessory. Each of the first and second sliding bars may have a means attached thereto for manually imparting sliding motion thereto.

DETAILED DESCRIPTION OF THE PREFERRED EMBODIMENT

Figure 6:
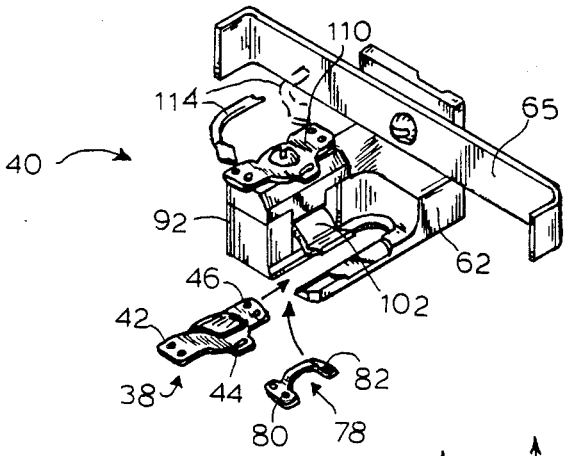
FIG. 6 is a perspective view of the accessory holding fixture of the present invention illustrating the adaptability of the clamp means and holding plate thereof to securing either a skirt hook or a skirt eye.

Button sewing fixtures are typically attached to industrial sewing machines by means of an arm-type holder extending parallel to the sewing machine arm, but below the machine arm and between it and the sewing plate. It is to this auxiliary arm that the present jig is attached. In the preferred embodiment of the invention, the novel jig is attached to such an auxiliary arm which terminates as a narrow flat bar. The novel jig is attached to the underside of the auxiliary arm by screws which pass through holes in the auxiliary arm and into threaded holes in the attachment plate of the novel jig.

The attachment plate of the novel jig contains a rectangular groove, oriented in the direction parallel to the auxiliary arm, for the entire length of the underside of the attachment plate. A rectangular-cross-section bar fits into the groove with sliding clearance and is held in place by a holding plate. The holding plate, which contains a matching groove, is held onto the attachment plate by machine screws in threaded holes. An accessory holder is attached to the end of the sliding bar which extends beyond the grooves. An actuating lever is attached to the underside of the jig and, when actuated manually, electrically or pneumatically, can move the sliding bar forward and backward by action upon a pin extending from the sliding bar and riding in a slot in the holding plate. A spring-loaded ball held in the holding plate by a thread insertion arrangement rides on a path on the sliding bar which preferably includes three depressions to act as detents to the bar movement and furnish specific repeatable locations. The novel jig therefore permits convenient motion parallel to the orientation of the sewing machine arm with several specific repeatable predetermined work positions.

A second similar sliding-bar arrangement may be attached between the end of the first sliding bar and the accessory holder to provide a second set of predetermined work positions transversely offset from the first set of locations to permit the stitching of accessories which contain thread holes not oriented in a straight line. This second sliding bar arrangement includes a second actuating lever or translation bar for moving the second sliding bar manually, electrically or pneumatically.

The accessory holder, has a vertical section at its rearward end which attaches to the jig and has a holding plate to hold a skirt hook or skirt eye. The accessory holder also contains a guide template mounted on a platform and having thread holes in corresponding locations to those in the accessory to be sewn.

A novel alignment system is included to complete the present invention. An indicator arm extends from the stationary jig attachment plate. The indicator arm has a pointer on an end thereof. When the pointer is lined-up with a thread-hole set on the guide template the sewing needle is aligned with the corresponding thread-hole set in the accessory to be sewn.

The entire system therefore furnishes a means for precisely aligning the thread holes in accessories with respect to the needle of the sewing machine quickly and accurately under the control of the machine operator to enable attachment of such accessories as skirt hooks and eyes at normal production speeds.

Figure 1:
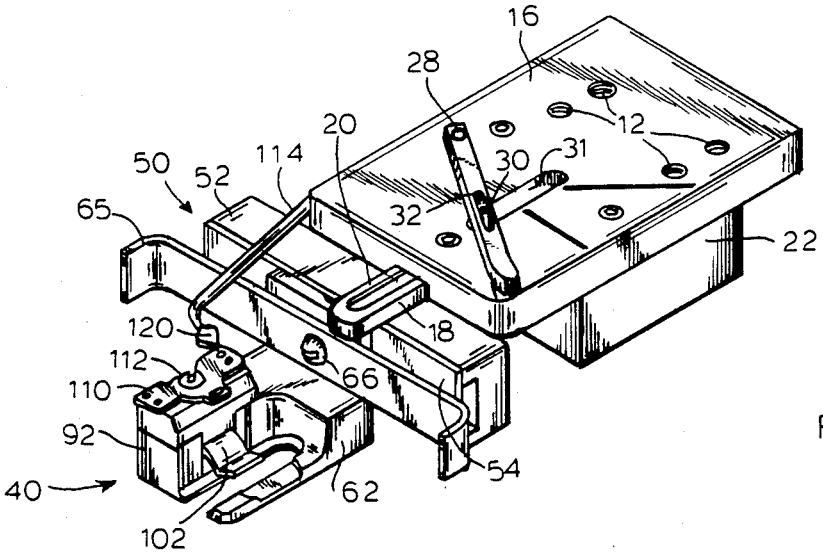
FIG. 1 is a perspective top view of the present invention.

FIG. 1 shows the novel jig 10 which, in operation, is attached to an auxiliary arm (not shown) by screws 14 which are inserted into threaded holes 12 in jig attachment plate 6. The attachment plate 16 has a first groove 18 located on the underside of the attachment plate 16 and is oriented parallel to the direction of the auxiliary arm which is itself mounted in a fixed relation with respect to the sewing needle, 48, parallel to the sewing machine arm (not shown) and between the sewing machine arm and the sewing surface (not shown).

A sliding bar 20 is located within the first groove 18 with clearances appropriate for sliding and is held within the first groove 18 by holding plate 22 which has a complementary second groove 23 to the first groove 18. The holding plate 22 is held in place below the attachment plate 16 by screws 24, thus, in combination with the attachment plate 16, capturing the sliding bar 20, but permitting linear movement controlled by a lever 26. A guide tab 21 is inserted into a threaded aperture in attachment plate 16 and matingly extends into groove 25 in sliding bar 20 to guide the linear movement of sliding bar 20.

As can be seen in FIG. 1 the lever 26 pivots on a pivot connection 28 and engages a pin 30 with a slot 32. Pin 30 is connected to the upper side of the sliding bar 20, and moves within a slot 31 cut on the upper side of the holding plate 22, thereby moving the sliding bar 20 away from the auxiliary arm (not shown) when the lever 26 is moved in direction A (FIGS. 4 and 5). Spring-loaded ball 34, which is held in the holding plate 22 by a threaded insert 36, rides upon a path on the side surface of the sliding bar 20, which has at least two circular depressions or detents 35 (shown in phantom in FIGS. 3 and 4) to determine specific locations of rest for the sliding bar 20 in its movement.

Figure 3:
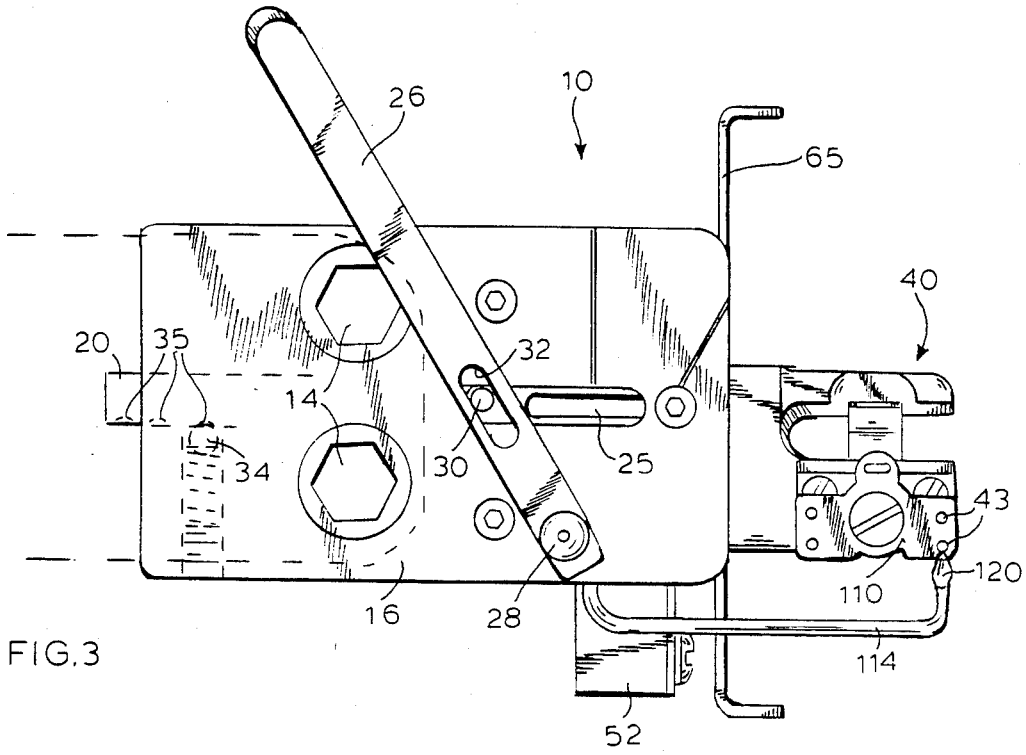
FIG. 3 is a top view of the invention which also illustrates the holding plate, and the spring-loaded ball and detent locking mechanism, in phantom.
Figure 4:
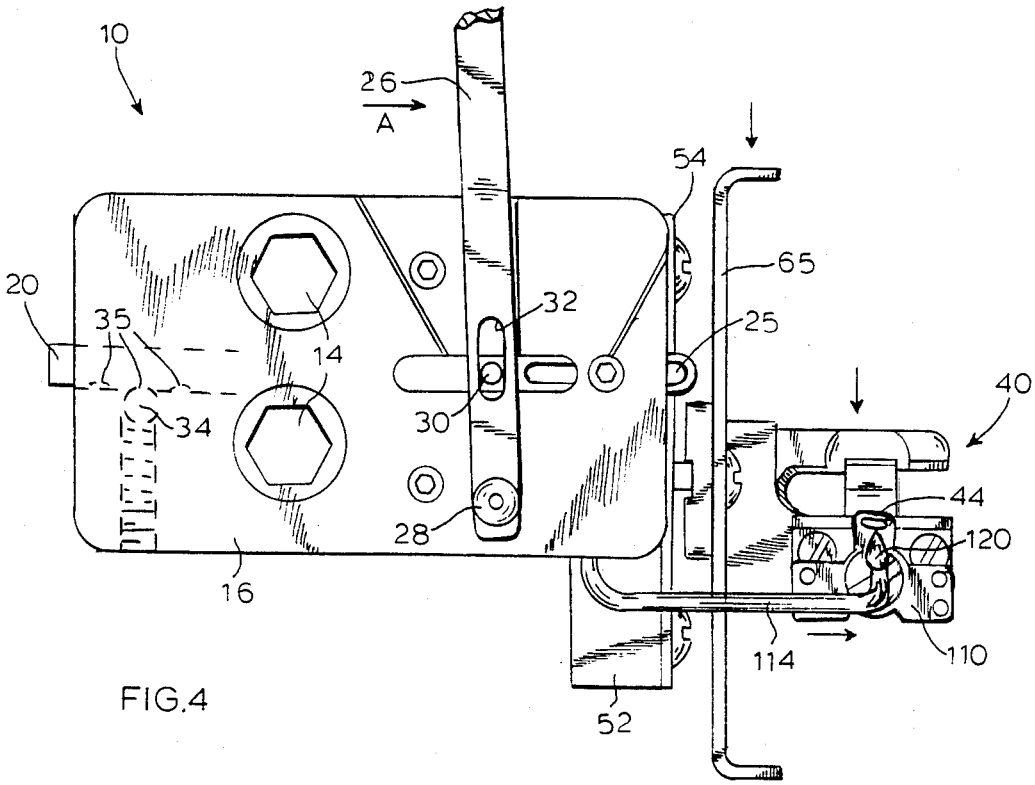
FIG. 4 is a top view wherein the lever has been advanced to a middle position thereby advancing the accessory holding fixture relative to the stationary alignment pointer. The transverse motion fixture has also been laterally translated thereby laterally translating the accessory holding fixture relative to the alignment pointer.
Figure 5:
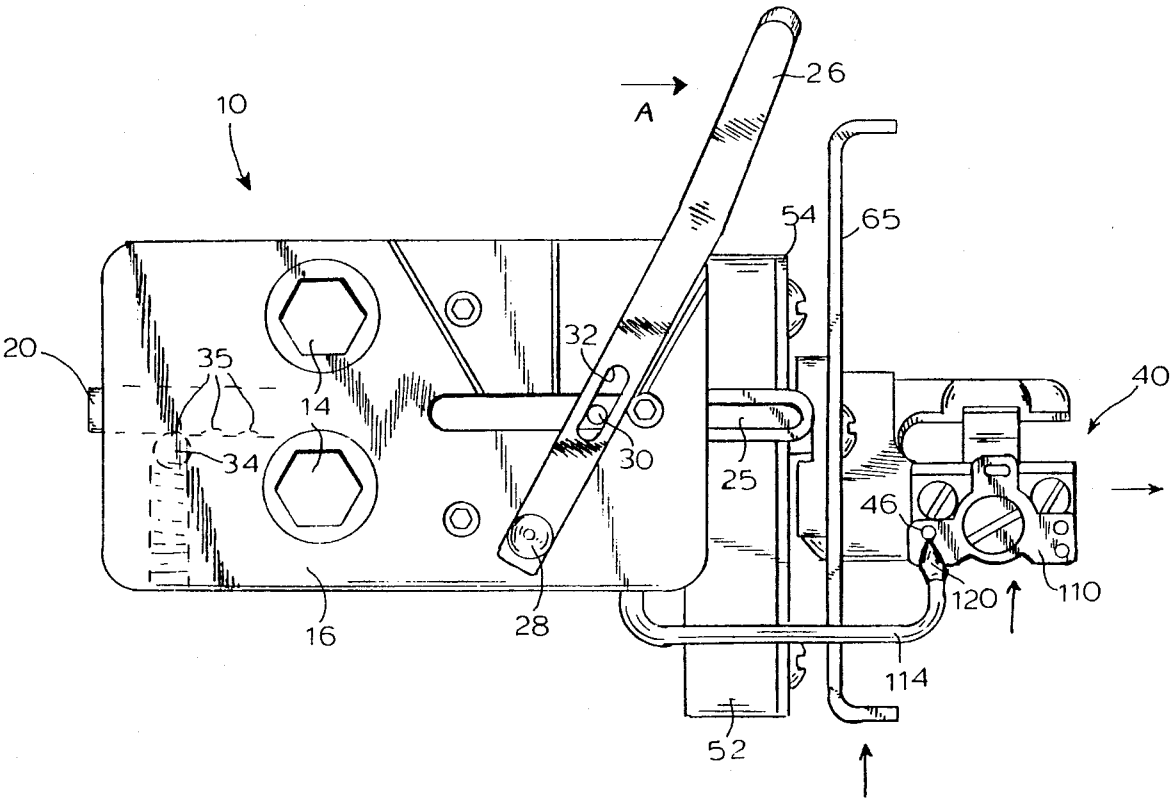
FIG. 5 is a top view illustrating the lever arm in a third and most advanced position.

Three rest positions, shown in FIGS. 3, 4 and 5 respectively, are provided according to the preferred embodiment. In all cases the location of the rest positions is determined by the linear displacement (in direction A) between the various sets of thread holes in the accessories to be stitched onto the fabric.

Referring now to FIG. 6 such an accessory, a skirt hook 38, is shown separate from the jig but adjacent to holding means 40. Skirt hook 38 has three sets of thread holes 42, 44, and 46. Since these sets of thread holes have three linear locations in direction A, lever arm also has three specific locations determined by the detents 35 in the sliding bar 20. However, as is apparent from the configuration of skirt hook 38, a transverse movement is also required to align thread-hole set 44 with the needle 48 if the needle 48 was previously aligned with either thread-hole set 42 or thread-hole set 46. This transverse motion is provided by a fixture 50 which is attached between the end of sliding bar 20 and the holding means 40. Fixture 50 is constructed with a grooved base 52 (see FIG. 2) and cover 54 retaining a second sliding bar 56 within a groove 58. Screw 60 and a similar screw 61 at the opposite end of groove 58 act as positive stops at the end of the movement of second sliding bar 56. Accessory holding fixture 62 and translation bar 65 are attached to second slide bar 56 by means of screw 66.

Holding clip 102 is designed to secure any of a number of various accessories, and, in particular, to secure either a skirt hook 38 or a skirt eye 78 (see FIG. 6). Also included on accessory holding means 40 is a platform the elements of which are, shown in an exploded view in FIG. 2, which includes raised portion 92 of accessory holding fixture 62. Mounted on raised portion 92 is a mounting piece 94 which is affixed to the raised portion by screws 96. A pin 98, projects from a groove 100 in accessory holding fixture 92. A clip 102, having an aperture for receiving pin 98 is mounted on the pin and set into groove 100. A spring 104 is then mounted on the portion of the needle which projects above clip 102. Mounting piece 94 contains a tongue portion which matingly extends into groove 100 when mounting piece 94 is mounted on the raised portion. The underside of the tongue portion contains a cylindrical aperture (not shown) which receives pin 98 and spring 104 when assembled. Pressure from the mounting piece upon spring 104 provides a downward spring force to clip 102. Clip 102 contains a bend which is adapted to hold an accessory when it is placed onto holding plate 106. The holding plate is configured so that either a skirt hook or a skirt eye may be placed on the plate so that it rests within recesses of the plate and so that the thread-hole sets of the accessory may be sewn to fabric which is below the plate without interference by the plate. An accessory placed on the plate is secured thereto by the downward spring force of clip 102.

Figure 7:
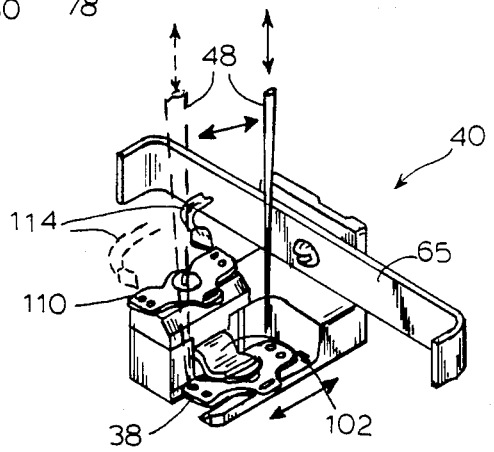
FIG. 7 is a perspective view of the accessory holding fixture of the present invention illustrating the sewing of a skirt hook, with solid lines illustrating the alignment pointer and sewing needle in a position to sew a first set of holes, and phantom lines illustrating the same alignment pointer and needle when adjusted to a position to sew a second set of holes.
Figure 2:
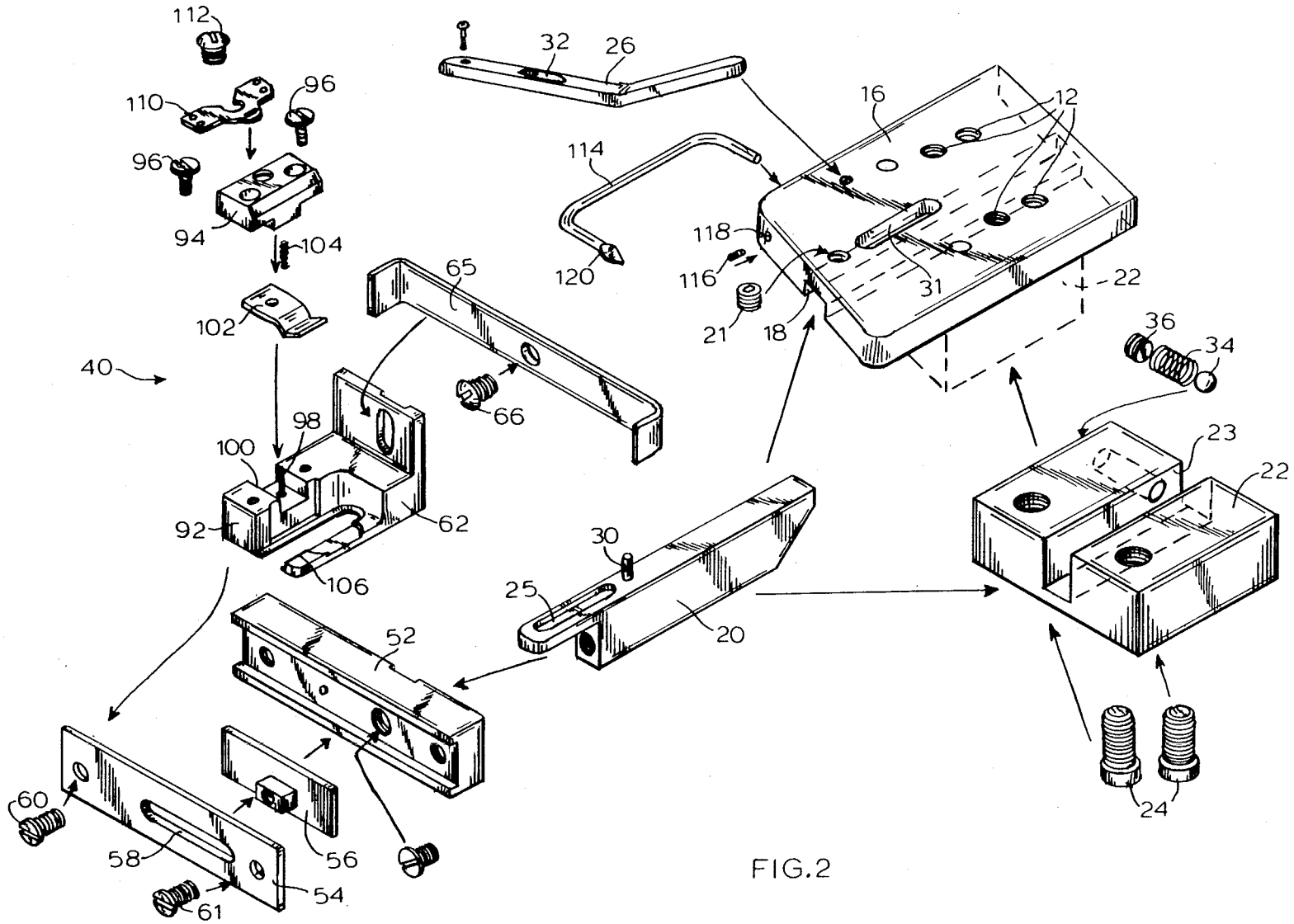
FIG. 2 is an exploded view, in perspective, of the parts of the present accessory holding jig with arrows to illustrate the manner of assembly of these parts to form a jig in accordance with the present invention.

The alignment system of the present invention will now be described. A guide template 110 is affixed to mounting piece 94 by a screw 112. The guide template is preferably a flat piece of sheet metal having thread-hole sets at locations corresponding to the thread-hole sets in the accessory to be sewn. For example, as shown in FIG. 7, a guide template in the form of the base portion of a skirt hook is mounted on platform 90. The configuration of the guide template is best seen in FIG. 2. Note that guide template 110 may be used to align the sewing needle 48 to sew both a skirt hook and a skirt eye since the thread-hole sets 80 and 82 of skirt eye 78 correspond to thread-hole sets 42 and 46 of skirt hook 38. A C-shaped indicator arm 114 is inserted on one end into an aperture in attachment plate 16. A threaded dowel 116 (see FIG. 2) is inserted into threaded aperture 118, transverse to the indicator arm, to secure the indicator arm to the attachment plate. On its other end the indicator arm contains a pointer 120. The pointer may be provided with bright coloring to aid the operator in aligning the pointer with a desired location on the guide template. Referring now to FIG. 7, when pointer 120 points to a given thread-hole set on the guide template, sewing needle 48 is aligned to sew the corresponding thread-hole set in the accessory. As a result of the guide template being laterally displaced from needle 48, and mounted on platform 90, the present alignment system is readily visible to the operator.

Adjustment of the jig to sew the various holes in a skirt hook or skirt eye is illustrated in FIGS. 3, 4 and 5. In FIG. 3 lever 26 is positioned in its rearwardmost position. Spring loaded ball 34 is urged into the corresponding detent 35 in sliding bar 20 to lock the holding means 40 in place. In this position the holding means is brought close to attachment plate 16, the pointer points to hole set 43 of the guide template indicating that needle 48 is aligned with thread-hole set 42 of skirt hook 38 or, alternately, with thread-hole 82 of skirt eye 78.

In FIG. 4 the jig is set in a position wherein the pointer indicates that thread-hole set 44 of the skirt hook is aligned for sewing. To achieve this position lever 26 is advanced so that spring loaded ball 34 is urged into the second detent in sliding bar 20 and the holding means is advanced away from attachment plate 16. In addition, to achieve the position illustrated in FIG. 4, translation bar 65 is translated from its furthermost left (when viewed from above) position to its furthermost right position as illustrated by the arrows in FIG. 4.

FIG. 5 illustrates lever 26 in its forwardmost position wherein the sewing needle is aligned to thread-hole set 44. Translation bar 65 has been returned to its furthermost left position.

The embodiment pictured therefore permits exact alignment of the thread holes on various accessories with the sewing machine needle and also permits rapid and accurate realignment of multiple sets of thread holes relative to each other.

It is to be understood that the form of the invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For instance, wire or sheet metal accessories may be held during stitching, and accessories with other shapes could be used with the present invention by simply using appropriately designed holding fixtures. Moreover, several detents could be used with second sliding bar 56 to yield more than two transverse positions for the jig and more detents could be added to the first sliding bar 20 to permit the stitching of may more sets of thread holes in the linear direction. An entire matrix of thread-hole sets can be determined by the combination of multiple positions of both sliding bars. In accordance with the device as disclosed the accessory holding plate may be adapted to hold any of a variety of accessories, and thus, with the introduction of an appropriate guide template, a single jig may be employed to sew a wide variety of accessories. Also, instead of manual positioning of the sliding bars, each sliding bar could be power driven; for example, electrically as with a solenoid, or pneumatically as with an air-driven piston.

What is claimed is:

1. A jig for holding an accessory having at least two thread holes while being stitched on a sewing machine comprising:

attachment means attachable to the sewing machine in predetermined relationship with respect to the needle of the sewing machine;

a first positioning means held in movable relationship with the attachment means; a holding means attached to and extending from the first positioning means to a location below the needle of the sewing machine, permitting the alignment of at least two thread holes on the accessory with the needle of the sewing machine when the first positioning means is moved to a desired location; and an alignment system comprising a guide means affixed to the holding means and an indicator means, affixed to the attachment means, which is aligned with a desired location on the guide means in order to indicate alignment of the needle of the sewing machine with a desired location on said accessory, wherein the guide means is moved relative to the indicator means upon movement of the first positioning means.

2. The jig defined in claim 1 wherein the first positioning means includes a first location-determining means to secure the first positioning means in a plurality of predetermined positions, said positions being separated by the same distance in one direction as two thread holes on said accessory and wherein the holding means permits alignment of thread holes on the accessory with the needle of the sewing machine when the first positioning means is in its predetermined positions.

3. The jig defined in claim 2 wherein the guide means is a guide template having thread holes at corresponding locations to those on said accessory.

4. The jig defined in claim 3 wherein the guide template is mounted on a platform located on the holding means, said platform being laterally displaced from the sewing needle.

5. The jig defined in claim 4 wherein the positioning means is actuated by a lever which is located on a top surface of the jig for ease of access by an operator.

6. The jig defined in claim 5 wherein the first positioning means is a first sliding means which is held in slidable relationship with the attachment means.

7. The jig defined in claim 6 including a second sliding means between said first sliding means and said holding means, said second sliding means being slidable in a direction that is transverse to the sliding motion of said first sliding means, and including second location-determining means to impede the second sliding means in at least two predetermined positions, said positions being separated by the same distances in said transverse direction as two sets of thread holes on said accessory.

8. The jig defined in claim 6 wherein the indicator means comprises an indicator arm affixed on one end to an attachment plate and having a pointer on its other end.

9. The jig defined in claim 6 wherein the guide template is a flat piece having the shape of the base portion of a skirt hook and having thread holes at identical locations to those on a skirt hook.

10. The jig defined in claim 7 wherein the pointer is provided with coloring to render it highly visible to an operator.

11. The jig defined in claim 7 further comprising a spring biased clip affixed to the holding means wherein the holding means further comprises a holding plate located below the spring biased clip, the holding plate having recesses adapted to receive one of a variety of accessories so that the spring biased clip secures the accessory to the holding means.

12. The jig in accordance with claim 11 wherein the holding plate contains a U-shaped opening therein having a first recessed area along the circumference of the U-shaped opening, and also having a second recessed area on an arm adjacent to the opening, the second recessed area being partially circular in shape, the first and second recessed areas being adapted to receive a skirt hook in one instance and a skirt eye in a second instance, the spring biased clip being adapted to secure the accessory to the holding plate.

13. The jig defined in claim 7 wherein the holding means contains a C-shaped translation bar to facilitate left to right (when viewed from above) translation of the second sliding means by an operator.

14. The jig defined in claim 13 wherein said first location-determining means is a spring-loaded ball held against a surface of the slidable means and said surface of the slidable means has means therein in the path which contacts the ball for impeding the first sliding means.

15. The jig defined in claim 14 wherein the second location-determining means has a stop at each end of the motion of the second sliding means.

* * * * *